United States Patent [19]

Petri

[11] 4,009,045

[45] Feb. 22, 1977

[54] CONTINUOUS CRYSTALLIZATION PROCESS AND APPARATUS

[75] Inventor: Peter H. Petri, LaPlace, La.

[73] Assignee: Godchaux-Henderson Sugar Co., Inc., Denver, Colo.

[22] Filed: Apr. 21, 1976

[21] Appl. No.: 678,937

[52] U.S. Cl. ..... 127/16; 23/230 A; 23/253 A; 127/19; 127/56; 127/60; 127/61; 159/44; 159/45

[51] Int. Cl.[2] ..... C13F 1/02; C13G 1/06

[58] Field of Search ..... 127/15, 16, 58, 60, 127/62, 61, 19, 56; 159/44, 45; 23/253 A, 230 A

[56] References Cited

UNITED STATES PATENTS

| | | | |
|---|---|---|---|
| 2,073,825 | 3/1937 | Beck | 127/16 X |
| 3,503,803 | 3/1970 | Bennett | 127/16 |
| 3,554,800 | 1/1971 | Javet | 127/16 |
| 3,556,845 | 1/1971 | Dambrine | 127/16 |
| 3,636,753 | 1/1972 | Thiele | 127/15 X |
| 3,680,621 | 8/1972 | Giorgi | 127/16 |
| 3,725,127 | 4/1973 | Retali | 127/16 |
| 3,899,386 | 8/1975 | Komiyama | 127/16 X |

OTHER PUBLICATIONS

*Sugar Industry Abstracts*, 27: Abstract 693 (1965).

*Primary Examiner*—Morris O. Wolk
*Assistant Examiner*—Sidney Marantz
*Attorney, Agent, or Firm*—Bruce G. Klaas; Dennis K. Shelton

[57] ABSTRACT

Sugar is continuously crystallized from a sugar bearing solution in a single stage vacuum pan by a method and apparatus comprising means for and the steps of continuously supplying a sugar bearing solution of a constant, desired purity to the vacuum pan by combining a relatively low purity sugar bearing solution flow stream with a relatively high purity sugar bearing solution flow stream while regulating the ratio of relatively low to relatively high purity sugar bearing solution in the combined flow stream, continuously supplying sugar seed crystals having a relatively uniform crystal size distribution to the vacuum pan, continuously boiling at least a portion of the sugar bearing solution and sugar seed crystals in the vaccum pan to form a boiling massecuite, and continuously removing at least a portion of the massecuite from the vacuum pan. Sugar crystals of at least a predetermined desired size are then continuously separated from the massecuite in a continuous centrifugal separator and conventionally further processed while the supernatant sugar bearing solution and sugar crystals smaller than the desired size are stored in a run-off storage tank for later conventional further processing.

13 Claims, 1 Drawing Figure

CONTINUOUS CRYSTALLIZATION PROCESS AND APPARATUS

BACKGROUND AND SUMMARY OF THE INVENTION

This invention relates to a method and apparatus for the continuous crystallization of sugar from a sugar bearing solution.

In the production of granular sugar from sugar beets and the like, the sugar must be separated from the plant tissue and then placed in a marketable, granular form. This is commonly accomplished by the steps of slicing the sugar beets into thin sections or "cossettes", allowing the sugar and some impurities to diffuse out of the plant tissue into surrounding diffusion juice, purifying the diffusion juice to form a "thin juice", evaporating the thin juice to form a "thick juice" and then crystallizing sugar from the thick juice.

Prior to crystallization, the thick juice is commonly "enriched" with remelt (redissolved) sugar and wash water to form a standard liquor solution. Since the standard liquor contains both sugar and non-sugar portions, the sugar must be separated from the non-sugars, usually by crystallization of the sugar from a supersaturated standard liquor solution. Supersaturation of the sugar in the solution is typically obtained by boiling the standard liquor under controlled conditions. To avoid burning, carmelization and invert sugar formation, boiling of the standard liquor is commonly carried out at a relatively low temperature and pressure in an apparatus known as a vacuum pan. A charge of standard liquor is taken into the vacuum pan and boiled until the liquor is supersaturated, i.e., until it contains a greater concentration of sugar in solution than the normal solubility of sugar in water at that temperature. At this point, sugar crystal nuclei are either permitted to form spontaneously, or the liquid is "shocked" by the injection of a controlled quantity of sugar seed crystals. By careful control of the condition of supersaturation through control of internal pressure, temperature, and solution density, the sugar crystals are permitted to grow until they reach a desired size. The mixture of standard liquor and crystallized sugar, known as massecuite, is then transferred to a mixer and then to centrifugal separation apparatus which separate the sugar crystals from the surrounding liquor. The sugar crystals are then washed with hot water, dried and processed for packaging.

Conventional vacuum pans for use in conjunction with the aforedescribed process are operated on a batchwise basis and require the use of experienced individuals, known as sugar boilers, who manually control the operating variables. Since the crystallization process is highly dependent upon such factors as temperature, pressure, purity of the standard liquor, degree of supersaturation, etc., manual operation of vacuum pans can result in a significant risk of operator error and wide variation between batches of sugar so processed. To overcome these problems, and to increase the efficiency of the crystallization process, it has previously been proposed to carry out crystallization of sugar on a continuous basis. For example, U.S. Pat. Nos. 2,160,533; 2,346,517; 2,587,293; 2,743,198; 3,424,221; 3,505,111; 3,506,486; 3,554,800; 3,556,845; 3,627,582 and 3,879,215 relate to such continuous processes. Prior art continuous crystallization processes and apparatus have dealt primarily with crystallization in multi-stage crystallization apparatus. Such approaches have met with limited success and have required relatively large capital expenditures in the conversion from single stage batch vacuum pans. Furthermore, due to varying quality of sugar beets and varying purity of diffusion juice in different segments of a sugar beet processing season, attempts to crystallize sugar on a continuous basis have heretofore been impractical.

It has now been discovered that a unique continuous process of sugar crystallization can be carried out, with significant economical savings, by a process and system which, in one embodiment, incorporates a single-stage, continuous crystallization system comprising a vacuum pan for continuously boiling a standard liquor solution at a regulated temperature and pressure, purity control means for regulating the ratio of components in the standard liquor in order to obtain a standard liquor solution having a constant, desired purity, standard liquor solution supply means for supplying the standard liquor solution of desired purity to the vacuum pan at a regulated rate, density control means for regulating the density of the standard liquor in the vacuum pan, seed crystal supply means for continuously supplying seed crystals to the vacuum pan at a constant, predetermined rate, a massecuite mixer for receiving a portion of the massecuite from the vacuum pan and maintaining sugar crystals in suspension in the massecuite, and a continuous centrifugal separation means for receiving massecuite from the massecuite mixer and separating the sugar crystals having at least a predetermined desired size from the surrounding liquor of the massecuite. The seed crystals are preferably introduced into the vacuum pan at a point above the boiling massecuite.

BRIEF DESCRIPTION OF THE DRAWING

A presently preferred and illustrative embodiment of the present invention is shown in the accompanying drawing, which schematically depicts various components that may be used in practicing the invention.

Referring now to the accompanying drawing, an illustrative system for the continuous crystallization of sugar from a sugar bearing solution generally comprises a supply means 10 for supplying relatively low purity sugar bearing solution to the vacuum pan, a supply means 12 for supplying relatively high purity sugar bearing solution to the vacuum pan, purity control means 14 for controlling the purity of sugar bearing solution supplied to the vacuum pan, vacuum pan 16 for continuously boiling the controlled purity sugar bearing solution and sugar seed crystals, seed crystal supply means 18 for continuously supplying seed crystals to the vacuum pan, massecuite mixer 20 for receiving massecuite overflowed from the vacuum pan and maintaining sugar crystals in suspension in the massecuite and centrifugal separation means 22 for receiving massecuite from the massecuite mixer and continuously separating product sugar crystals from the massecuite.

Figure 1:
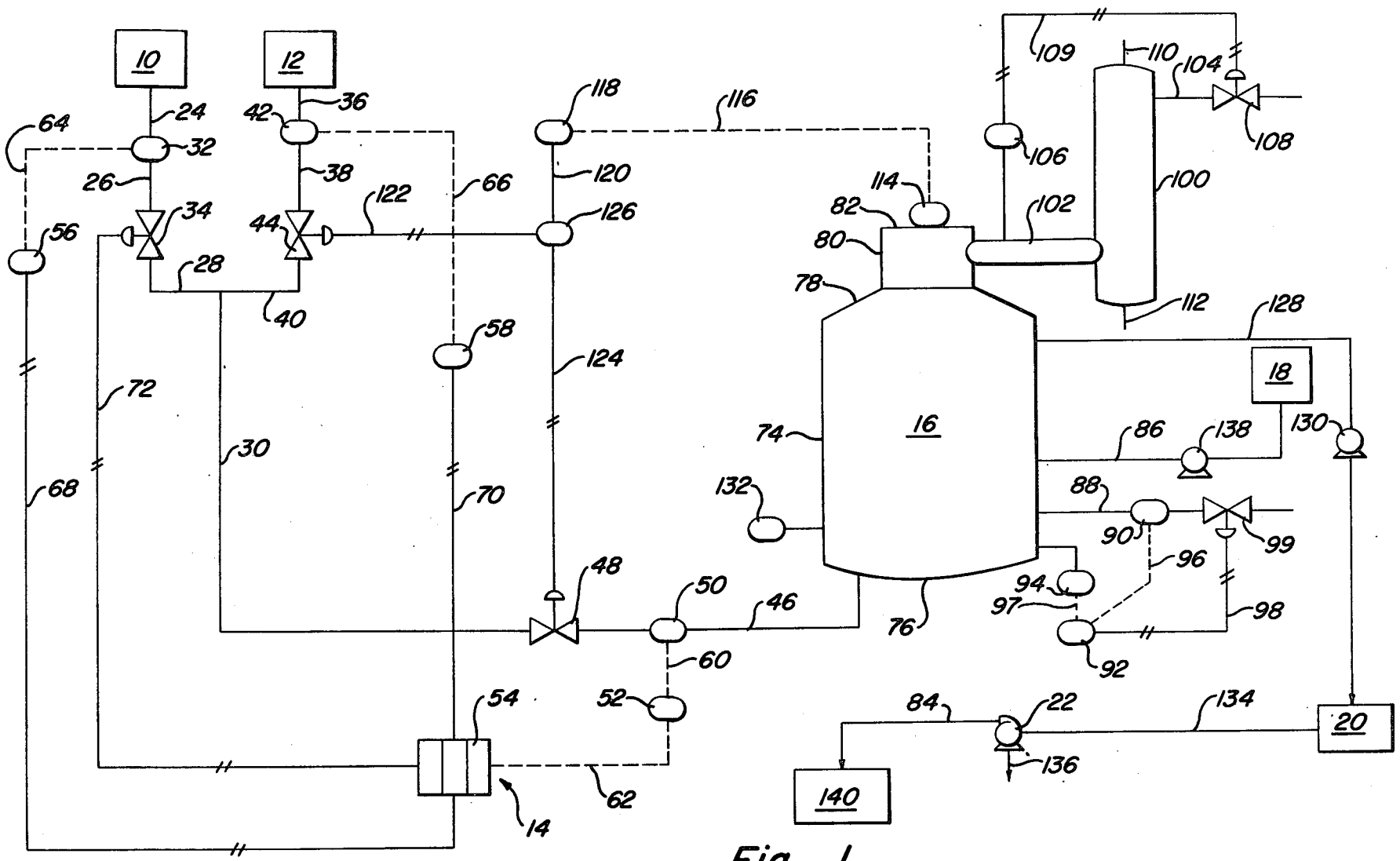

The supply means 10 for supplying relatively low purity sugar bearing solution to the vacuum pan can be any suitable structure, e.g., a supply tank, capable of continuously supplying a sugar bearing solution having a relatively low purity, e.g., about 54.0 to about 68.0 percent sugar to total dissolved solids, to the vacuum pan. Relatively low purity sugar bearing solution supply conduit sections 24, 26, 28 provide fluid communication between the supply means 10 and conduit section 30 where the relatively low purity sugar bearing solution flow stream is combined with a relatively high purity sugar bearing solution flow stream from supply means 12. Flow rate measuring means, such as flow rate meter 32, for measuring the rate at which relatively low purity sugar bearing solution flows through the supply conduit sections is located in interconnecting relationship between supply conduit sections 24, 26. The flow rate meter may be, for example, a magnetic flow meter, a turbine (rotary vane) flow meter, an orifice-plate flow meter or a pitot tube flow meter, as defined in McGinnis, *Beet Sugar Technology*, 2nd Edition 1971, page 675. Flow rate control means, such as remotely controllable variable valve 34, for directly controlling the rate of flow of relatively low purity sugar bearing solution through the supply conduit sections is located in interconnecting relationship between supply conduit sections 26, 28 and is capable of being remotely controlled as, for example, by pneumatic or solenoid control means.

The supply means 12 for supplying relatively high purity sugar bearing solution to the vacuum pan can be any suitable structure, e.g., a supply tank, capable of continuously supplying a sugar bearing solution having a relatively high purity, e.g., about 78.0 to about 84.0 percent sugar to total dissolved solids, to the vacuum pan. Relatively high purity sugar bearing solution supply conduit sections 36, 38, 40 provide fluid communication between the supply means 12 and conduit section 30, where the relatively high purity sugar bearing solution flow stream is combined with the relatively low purity sugar bearing solution flow stream from supply means 10. Flow rate measuring means, such as flow rate meter 42, for measuring the rate at which relatively high purity sugar bearing solution flows through the supply conduit sections is located in interconnecting relationship between supply conduit sections 36, 38 and is similar to flow rate meter 32. Means for directly controlling the rate of flow of relatively high purity sugar bearing solution through the supply conduit sections, such as remotely controllable variable valve 44, is located in interconnecting relationship between supply conduit sections 38, 40 and may be similar to remotely controllable variable valve 34.

The relatively low and relatively high purity sugar bearing solution flow streams flow through supply conduit sections 24, 26, 28, and 36, 38, 40, respectfully, and are combined into a single combined flow stream in controlled purity sugar bearing solution supply conduit sections 30, 46.

Controlled purity sugar bearing solution supply conduit sections 30, 46 provide fluid communication between relatively low purity sugar bearing solution supply conduit section 28 and relatively high purity sugar bearing solution supply conduit section 40, and the vacuum pan 16. Means for directly controlling the rate of flow of the combined relatively low and relatively high purity flow streams through the supply conduit sections 30, 46 to the vacuum pan, such as remotely controllable variable valve 48, is located in interconnecting relationship between supply conduit sections 30, 46 and may be similar to valves 34, 44.

The purity control means 14 for controlling the purity of sugar bearing solution supplied through supply conduit sections 30, 46 to vacuum pan 16 and maintaining the purity at a constant, desired level, e.g., about 74 to about 76 percent sugar to total dissolved solids, generally comprises a solution conductivity sensing means, such as conductivity sensor 50, for sensing the conductivity of the sugar bearing solution in supply conduit section 46, solution conductivity measuring means, such as conductivity meter 52, for measuring the conductivity of sugar bearing solution in supply conduit section 46 as sensed by sensor 50, ratio control means, such as ratio controller 54, for controlling the ratio of the rate of flow of the relatively low to the relatively high purity sugar bearing solution flow streams flowing through supply conduit sections 28, 40, respectively, to maintain a combined flow stream of constant, desired purity in supply conduit sections 30, 46, flow rate meters 32, 42, converter means 56, 58 for converting electrical signals from measuring means 32, 42 to pneumatic signals and remotely controllable variable valve 34.

Solution conductivity sensor 50 is located in an intermediate portion of controlled purity sugar bearing solution supply conduit section 46 and is adapted to sense the conductivity of sugar bearing solution in the supply conduit section 46. The conductivity meter 52 measures and provides a signal representative of the conductivity of the controlled purity sugar bearing solution in response to electrical impulses supplied by the sensor 50 along electrical path 60. The signal representative of the conductivity of the controlled purity sugar bearing solution is transmitted to the ratio controller 54 over path 62. The conductivity of a sugar bearing solution is directly proportional to ionic impurities present in the solution and indirectly proportional to the solution's purity, so that conductivity meter 52, in effect, indirectly measures the purity of the controlled purity sugar bearing solution in supply conduit section 46. The rate of flow of sugar bearing solution through supply conduit sections 24, 26, 28 and 36, 38, 40 as measured by flow rate meters 32, 42, is embodied in an electrical signal generated by the flow meters and supplied along electrical paths 64, 66 to the converter means 56, 58, respectively. The converter means convert these electrical signals to pneumatic signals which are conducted along pneumatic flow paths 68, 70 to the ratio controller 54. The ratio controller integrates the pneumatic signals representative of the respective flow rates of relatively low and relatively high purity sugar bearing solution as measured by flow meters 32, 42, respectively, with the conductivity of sugar bearing solution in conduit section 46 as measured by conductivity meter 52 and a pre-set desired purity level to regulate the ratio of the rate of flow of relatively low purity sugar bearing solution through supply conduit sections 24, 26, 28 to the rate of flow of relatively high purity solution through supply conduit sections 36, 38, 40. The ratio controller 54 maintains the desired degree of purity in supply conduit section 46 by generating a control signal, e.g., a pneumatic signal, along path 72 and thereby controlling remotely controllable variable valve 34, which may be, for example, pneumatically operable, to decrease the flow of relatively low purity sugar bearing solution through valve 34 if the desired purity level of the controlled purity combined flow stream, as manually set in the ratio controller 54, is higher than that presently in supply conduit section 46, or to increase the flow of relatively low purity sugar bearing solution through valve 34 if the desired purity level of the combined stream is lower than that presently in supply conduit section 46.

The single stage vacuum pan means, such as vacuum pan 16, for continuously boiling the sugar bearing solution and sugar seed crystals to form a massecuite is of a commonly known single stage design generally described in McGinnis, *Beet Sugar Technology*, 2nd Edition (1971), pages 400–403, and generally comprises a relatively large cylindrical body member 74 having a closed bottom wall 76, upwardly inwardly converging upper sidewall portion 78, relatively small cylindrical upper sidewall portion 80 and closed top wall 82. The vacuum pan is adapted to receive controlled purity sugar bearing solution from supply conduit section 46 and seed crystals from seed crystal supply means 18 through supply conduit 86.

The vacuum pan is provided with internal heating surfaces (not shown) in an intermediate bottom portion of the vacuum pan for providing sufficient heat to maintain massecuite in the vacuum pan in a boiling condition. Steam is supplied to the heating surfaces through steam supply conduit section 88. The flow of steam into the heating surfaces is maintained at a constant level by steam flow rate meter 90 and steam level recorder-controller 92 or may be shut off by massecuite level sensor 94 and steam level recorder-controller 92 if the massecuite drops below a preestablished level in the vacuum pan. The steam flow rate meter 90 may be of any suitable type, but is preferably of the orifice-plate type. If the rate of flow of steam through steam supply conduit 88, as measured by steam flow rate meter 90 and transmitted to steam level recorder-controller 92 along electrical path 96 falls below a predetermined level, the steam level recorder-controller is operative along path 98 to open remotely controllable variable valve 99 which may be, for example, pneumatically operable. Similarly, if the flow of steam rises too high, steam level recorder-controller 92 is operative to close variable valve 99 accordingly. If the level of massecuite in the vacuum pan falls below a predetermined level, e.g., a point somewhat above the top of the heating surfaces, as determined by the massecuite level sensor 94 and transmitted to the steam level recorder-controller 92 along electrical path 97 the recorder-controller is operative along pneumatic path 98 to stop the flow of steam to the heating surfaces by closing remotely controllable variable valve 99.

Condensor 100, having internal condensor coils or trays (not shown), is interconnected to upper sidewall 80 of the vacuum pan by conduit section 102. Water is supplied to the condensor coils or trays from a water supply source (not shown) through water supply conduit section 104. The internal pressure of the vacuum pan is maintained at a constant, desired subatmospheric level, e.g., about 5 to about 6 in. absolute, to maintain the temperature of massecuite boiling in the vacuum pan at a reduced level, e.g., about 150° to about 160° F, by the rate of flow of raw water through the condensor coils or trays in condensor 100. Absolute pressure-recorder-controller 106, having a pressure sensitive probe (not shown) located in an intermediate portion of conduit section 102, is adapted to sense the internal pressure of conduit section 102 and to maintain the pressure at a predetermined, desired level by controlling remotely controllable variable valve 108 along control path 109 and thereby regulating the flow of water to the condensor coils or trays. Conduit sections 110, 112 interconnect condensor 100 with a conventional vacuum source and catchall tank, and a conventional seal tank, respectively.

Massecuite density measuring means 114 for continuously measuring the density of the massecuite in the vacuum pan 16, as for example, by measuring the resistance to turning of an impellor (not shown) in the massecuite, generates an electrical signal representative of the massecuite density along electrical path 116 to a massecuite tightness control means, such as tightness controller 118. Based upon this signal representative of the density of the massecuite in the vacuum pan, tightness controller 118 maintains the massecuite density at a constant, predetermined level by alternatively controlling either of remotely controllable variable valves 44 or 48 in response to the need for additional controlled purity sugar bearing solution in the vacuum pan 16. The tightness control means 118 controls remotely controllable variable valve means 44, 48, as for example, along pneumatic flow paths 120, 122 or 120, 124, respectively. Manually operable selector switch 126 is set to determine which of the pneumatic flow paths 120, 122, or 120, 124 the tightness controller 118 will affect as may be desired by the system operator.

Sugar seed crystal supply means 18 for continuously supplying sugar seed crystals having a relatively uniform crystal size distribution to the vacuum pan 16, can be of any suitable structure, e.g., a supply tank equipped with a mechanical mixer, capable of continuously supplying sugar seed crystals, preferably as an alcohol-sugar crystal slurry, to the vacuum pan at a constant, predetermined rate. Seed crystal supply conduit section 86 provides fluid communication between seed crystal supply means 18 and the vacuum pan 16, and continuously discharges seed crystals into an intermediate portion of vacuum pan 16, preferably at a point somewhat above the boiling massecuite to insure uniform distribution of the seed crystals in the boiling massecuite and to minimize dissolution of the minute seed crystals. Variable speed pump 138, located in an intermediate portion of conduit section 86 regulates the rate at which seed crystals are supplied to the vacuum pan, and may be manually set for a constant, desired rate of supply of seed crystals to the vacuum pan. In order to obtain sugar product crystals of a uniform desired size, it is particularly important that the sugar seed crystals have a relatively narrow, uniform crystal size distribution. The seed crystals preferably have an average size of approximately 150 to 250 microns, more preferably approximately 175 to 225 microns and most preferably approximately 195 to 205 microns. For example, relatively uniform seed crystals of this order may be obtained in accordance with U.S. Pat. No. 3,695,932 to Randolph and U.S. Pat. No. 3,503,803 to Swenson. Highly uniform crystals having an average size on the order of 60 to 100 microns are obtained by developing the crystal nuclei in a medium of supersaturated sucrose solution and a critical amount of low molecular weight polar organic compound, preferably ethanol. These highly uniform seed crystals are then grown to the desired average size of about 200 microns in a forced circulation crystallization apparatus prior to being introduced into the apparatus of the present invention. This method of seed nucleation and development is presented for purposes of illustration, since any method capable of producing seed crystals having a uniform size of approximately 200 microns may be used as a seed crystal supply source in conjunction with the present invention.

Massecuite temperature recorder 132, having a temperature sensing probe (not shown) in the boiling massecuite, may be optionally provided to continuously record the temperature of the massecuite in vacuum pan 16.

As sugar bearing solution of desired purity and sugar seed crystals are continuously added to the vacuum pan, massecuite containing sugar crystals of varying sizes and dissolved solids is continuously removed from the vacuum pan and flows into massecuite mixer. Means for removing at least a portion of the massecuite from the vacuum pan at a regulated rate to maintain a constant level of massecuite in the vacuum pan, such as overflow conduit section 128, extends in fluid communication between an intermediate top portion of cylindrical body member 74 and the massecuite mixer 20. Variable speed pump 130, located in an intermediate portion of overflow conduit section 128, controls the rate at which massecuite is removed from the vacuum pan and flows to the massecuite mixer.

Massecuite mixer means, such as mixer 20, for continuously mixing massecuite received from the vacuum pan 16 through overflow conduit section 128, can be of any suitable structure, e.g., a holding tank equipped with a mechanical stirrer (not shown), capable of keeping the sugar crystals evenly dispersed in the massecuite. The massecuite mixer functions to prevent the sugar crystals from settling out of the massecuite before it is transferred to the product sugar crystal separation means 22. Overflow conduit section 134 provides fluid communication between an intermediate top portion of the massecuite mixer 20 and the separation means 22 and is adapted to continuously convey a portion of the massecuite from the massecuite mixer to the separation means.

Continuous product sugar crystal separation means, such as continuous centrifugal separator 22 is adapted to continuously receive massecuite from the massecuite mixer 20 through conduit section 134 and to continuously separate product sugar crystals which have grown to at least a desired, predetermined size, e.g., crystals larger than about 400 microns, from the remainder of the massecuite. The continuous centrifugal separator can be of a commonly known design discussed in McGinnis, *Beet Sugar Technology*, 2nd Edition (1971) pages 431–444 and appropriate modifications can be made to function in white, intermediate and low raw applications. Conduit section 136 is adapted to discharge the separated product sugar crystals from the centrifugal separator 22 and to convey the product sugar crystals to a remote point for conventional further processing. Conduit section 84 provides fluid communication between the centrifugal separator 22 and a run-off storage tank 140, in which run-off from the separator is stored for conventional further processing for recovery of additional sugar crystals from the run-off.

The various measuring and control apparatus of the aforedescribed system may be embodied in the illustrative apparatus of Table I, although it is to be understood that other apparatus for accomplishing substantially the same purpose may also be used.

By utilizing the foregoing system according to the inventive concepts, sugar is continuously crystallized from a sugar bearing solution by supplying the relatively low purity sugar bearing solution from supply means 10 to supply conduit section 30, supplying the relatively high purity sugar bearing solution from supply means 12 to supply conduit section 30, controlling the ratio of the rate of flow of the relatively low to the relatively high purity sugar bearing solution flow streams into supply conduit section 30 to obtain a sugar bearing solution having a constant desired purity in supply conduit section 30, supplying the controlled purity sugar bearing solution in supply conduit section 30 to the vacuum pan 16 at a regulated rate, continuously supplying sugar seed crystals from seed crystal supply means 18 to the vacuum pan 16 at a regulated rate, continuously boiling the sugar bearing solution and the sugar seed crystals in the vacuum pan 16 at a regulated temperature and pressure to form a supersaturated massecuite and to provide for growth of the sugar seed crystals in the massecuite, continuously removing at least a portion of the massecuite from the vacuum pan at a regulated rate and continuously separating product sugar crystals of at least a predetermined size from the massecuite.

TABLE 1

| COMPONENT | DRAWING REF. No. | MANUFACTURER | MODEL |
|---|---|---|---|
| Conductivity Probe and Meter | 50, 52 | Balsbaugh | Series 900 Model 910-200C |
| Ratio Controller | 54 | Fischer-Porter | 51-1102, WRWR15FXX, 53PP4512 |
| Flow Rate Meter | 32 | Fischer-Porter | 10D1418A |
| | 42 | Foxboro | 2483603-Style A |
| Electric-pneumatic Converter | 56, 58 | Foxboro | 69TA-1 |
| Density Meter | 114 | Sangamo Electric Company | Type CW10 |
| Absolute Pressure Probe and Recorder | 106 | Fischer-Porter | Fig. No. 1122PE11 Series B6 |
| Temperature Recorder | 132 | Honeywell | 5312-14-00 |
| Steam Level Recorder-Controller | 92 | Foxboro | Model 40 |

The size of sugar product crystals obtained in accordance with the invention is a function of the initial size of the sugar seed crystals, the retention time of the crystals in the vacuum pan, the degree of saturation of the massecuite in the vacuum pan and the internal temperature and pressure of the vacuum pan. Therefore, in order to obtain relatively uniform sugar product crystals, the saturation of the massecuite in the vacuum pan is maintained at a constant, controlled level by regulating the rate of supply of controlled purity sugar bearing solution to the vacuum pan; supplying sugar seed crystals having a uniform size to the vacuum pan at a constant, regulated rate; maintaining the total time that the sugar crystals are retained in the vacuum pan from the time of introduction as seed crystals until removal as part of the massecuite at a steady level by regulating the rate of removal of the massecuite from the vacuum pan and maintaining the internal temperature and pressure of the vacuum pan at a constant, desired level. Optimal operating parameters for these conditions will be dependent on the particular application as will be apparent to a person skilled in the art. Adequate instrumentation should be provided so that the system operator can make appropriate adjustments in the system when required.

In the practice of the inventive concepts, many advantages are realized over batchwise operation of single stage vacuum pan apparatus. For example, increased operating capacity is obtained by eliminating non-productive portions of the batch cycle, continuous operation requires less steam utilization, sugar loss through vapor entrainment is minimized, the operating conditions may be maintained at a stable level, i.e., without peaks, and continuous operation requires little manual control thereby resulting in labor savings.

While inventive concepts have been herein disclosed in reference to a presently preferred and illustrative embodiment of the invention, it is contemplated that these concepts may be variously otherwise employed in alternate arrangement in continuous sugar crystallization apparatus. It is intended that the appended claims be construed to cover alternate embodiments of the inventive concepts except insofar as precluded by the prior art.

What is claimed is:

1. An apparatus for continuously crystallizing sugar from a sugar bearing solution formed as a mixture of a relatively low purity sugar bearing solution and a relatively high bearing sugar solution, comprising:

a single stage vacuum pan means for continuously boiling a sugar bearing solution and sugar seed crystals at a regulated temperature and pressure to form a massecuite, means for continuously supplying a relatively low purity sugar bearing solution to form a relatively low purity sugar bearing solution flow stream, means for continuously supplying a relatively high purity sugar bearing solution to form a relatively high purity sugar bearing solution flow stream, means for combining the relatively low purity sugar bearing solution flow stream with the relatively high purity sugar bearing solution flow stream to form a mixture of the relatively low purity sugar bearing solution and the relatively high purity sugar bearing solution in a combined flow stream, a purity control means for controlling the purity of the sugar bearing solution in the combined flow stream by regulating the ratio of the rate of flow of the relatively low purity sugar bearing solution flow stream to the rate of flow of the relatively high purity sugar bearing solution flow stream into the combined flow stream, means for supplying the combined flow stream to the vacuum pan at a regulated rate, a sugar seed crystal supply means for supplying sugar seed crystals to the vacuum pan means at a regulated rate, means for removing at least a portion of the massecuite from the vacuum pan means at a regulated rate to maintain a constant level of massecuite in the vacuum pan means, and means for continuously separating product sugar crystals from the removed massecuite.

2. The apparatus of claim 1 wherein the purity control means comprises:

a solution conductivity sensor means for sensing the conductivity of the sugar bearing solution in the combined flow stream, a solution conductivity measuring means responsive to the conductivity of the sugar bearing solution in the combined flow stream as sensed by the solution conductivity sensor means for measuring the conductivity of the sugar bearing solution in the combined flow stream, a first flow rate measuring means for measuring the rate of flow of the relatively low purity sugar bearing solution into the combined flow stream, a second flow rate measuring means for measuring the rate of flow of the relatively high purity sugar bearing solution into the combined flow stream, flow rate control means for directly controlling the rate of flow of the relatively low purity sugar bearing solution into the combined flow stream, and a ratio control means responsive to the solution conductivity measuring means, the first flow rate measuring means, the second flow rate measuring means and a predetermined desired purity level, the ratio control means being operatively connected to the flow rate control means to alter the flow rate control means as required to maintain the purity of the sugar bearing solution in the combined flow stream at a constant, desired level.

3. The apparatus of claim 1 wherein the means for regulating the rate of supply of the combined flow stream to the vacuum pan means comprises:

means for continuously measuring the density of the massecuite in the vacuum pan means, means for regulating the rate of flow of the combined flow stream into the vacuum pan means, and a tightness control means responsive to the density of the massecuite in the vacuum pan means as measured by the massecuite density measuring means and to a predetermined desired density level, the tightness controller being operatively connected to the means for regulating the rate of flow of the combined flow stream into the vacuum pan means to alter the regulating means necessary to maintain the density of the massecuite in the vacuum pan means at a predetermined desired level.

4. The apparatus of claim 1 wherein the sugar seed crystal supply means supplies the seed crystals to the vacuum pan means above the level of the massecuite in the vacuum pan means.

5. The apparatus of claim 1 wherein the means for continuously removing at least a portion of the massecuite from the vacuum pan means is an overflow conduit providing fluid communication between the vacuum pan means and the means for continuously separating product sugar crystals from the removed massecuite, and a variable speed pump in an intermediate portion of the overflow conduit, the variable speed pump being adapted to regulate the rate of removal of the massecuite from the vacuum pan means to maintain a constant level of massecuite in the vacuum pan means.

6. The apparatus of claim 1 which further comprises a massecuite mixer means intermediate the vacuum pan and the means for continuously separating product sugar crystals from the removed massecuite, for receiving the massecuite removed from the vacuum pan means and maintaining sugar crystals in suspension within the massecuite prior to transferring the massecuite to the means for continuously separating product sugar crystals from the removed massecuite.

7. The apparatus of claim 1 wherein the means for continuously separating product sugar crystals from the massecuite is a centrifugal separator.

8. A method of continuously crystallizing sugar from a sugar bearing solution formed as a mixture of a relatively low purity sugar bearing solution and a relatively high purity sugar bearing solution, comprising:

supplying a relatively low purity sugar bearing solution to form a relatively low purity sugar bearing solution flow stream, supplying a relatively high purity sugar bearing solution to form a relatively high purity sugar bearing solution flow stream, combining the relatively low purity sugar bearing solution flow stream with the relatively high purity sugar bearing solution flow stream to form a combined flow stream, controlling the ratio of the rate of flow of the relatively low purity sugar bearing solution to the rate of flow of the relatively high purity sugar bearing solution into the combined flow stream to obtain a sugar bearing solution of controlled purity in the combined flow stream, continuously supplying the combined flow stream to a vacuum pan at a regulated rate, continuously supplying sugar seed crystals to the vacuum pan at a regulated rate, continuously boiling the controlled purity sugar bearing solution and the sugar seed crystals into the vacuum pan at a regulated temperature and pressure to form a massecuite, continuously removing a portion of the massecuite from the vacuum pan at a regulated rate to maintain a constant level of massecuite in the vacuum pan, and continuously separating product sugar crystals of at least a desired size from the remainder of the removed massecuite.

9. The method of claim 8 wherein the ratio of the rate of flow of the relatively low purity sugar bearing solution to the rate of flow of the relatively high purity sugar bearing solution into the combined flow stream is controlled by sensing the conductivity of the sugar bearing solution in the combined flow stream, measuring the conductivity of the sugar bearing solution in the combined flow stream in response to its sensed conductivity, measuring the rate of flow of the relatively low purity sugar bearing solution into the combined flow stream, measuring the rate of flow of the relatively high purity sugar bearing solution into the combined flow stream, and directly controlling the rate of flow of the relatively low purity sugar bearing solution into the combined flow stream in response to the conductivity of the sugar bearing solution in the combined flow stream, the rate of flow of relatively low purity sugar bearing solution into the combined flow stream, the rate of flow of relatively high purity sugar bearing solution in the combined flow stream and a predetermined desired purity level.

10. The method of claim 8 wherein the rate at which the combined flow stream is continuously supplied to the vacuum pan is regulated by measuring the density of the massecuite in the vacuum pan and controlling the rate of supply of the combined flow stream to the vacuum pan in response to the density of the massecuite in the vacuum pan and a predetermined desired density level.

11. The method of claim 8 which further comprises supplying the sugar seed crystals to the vacuum pan at a point above the level of the massecuite in the vacuum pan.

12. The method of claim 8 which further comprises mixing the massecuite to maintain the sugar crystals in suspension in the massecuite prior to continuously separating product sugar crystals from the massecuite.

13. The method of claim 8 wherein the product sugar crystals are separated from the remainder of the massecuite by centrifugally separating the product sugar crystals from the remainder of the massecuite.

* * * * *